United States Patent [19]

McDaniel

[11] Patent Number: 4,483,564

[45] Date of Patent: Nov. 20, 1984

[54] OIL WELL SUCKER ROD SAFETY BLOCK

[75] Inventor: David L. McDaniel, Cleveland, Okla.

[73] Assignee: McDanco, Inc., Tulsa, Okla.

[21] Appl. No.: 404,364

[22] Filed: Aug. 2, 1982

[51] Int. Cl.[3] ..... B66C 1/00

[52] U.S. Cl. ..... 294/91; 248/49; 138/106; 166/77.5; 166/85

[58] Field of Search ..... 248/49, 58; 166/77.5, 166/79, 85; 294/90, 91; 188/67; 285/419; 16/114 R; 138/103, 106, 107, 110; 254/29 R; 269/287

[56] References Cited

U.S. PATENT DOCUMENTS

| | | | |
|---|---|---|---|
| 1,196,647 | 8/1916 | Bergsten . | |
| 1,434,673 | 11/1922 | Bergsten | 294/91 |
| 1,436,621 | 11/1922 | Coultas . | |
| 1,564,977 | 12/1925 | Schlinger . | |
| 1,581,270 | 4/1926 | Knisley | 294/90 |
| 1,766,920 | 6/1930 | Moody . | |
| 2,009,942 | 7/1933 | Moody . | |
| 2,300,370 | 10/1942 | Lowery . | |
| 2,397,516 | 4/1946 | Stewart | 188/67 |
| 3,048,358 | 8/1962 | Raulins | 248/49 |
| 3,682,023 | 8/1972 | Greene, Jr. | 16/114 R |
| 3,877,740 | 4/1975 | Carvell | 292/216 |

*Primary Examiner*—William H. Schultz
*Assistant Examiner*—Robert A. Olson
*Attorney, Agent, or Firm*—Head, Johnson & Stevenson

[57] ABSTRACT

A fail-safe knock-off block for use during the repair or servicing of oil well surface pumping equipment involving a longitudinally slotted pipe capped at each end by top and bottom pipe segments which are held in place concentric to the slotted pipe by a resilient handle. An inner handle on the slotted pipe allows the concentric caps to be rotated axially from an open position to a closed position, thus encircling the polish rod. The weight of the sucker rod string on the end caps during use compresses the end caps and resilient handle thus locking the safety block such that it can neither open nor come off the well head.

3 Claims, 3 Drawing Figures

OIL WELL SUCKER ROD SAFETY BLOCK

BACKGROUND OF THE INVENTION

1. Field of the Invention

This invention relates to an oil well sucker rod safety block. More specifically, the invention relates to a safety knock-off block that during operation completely encircles the sucker rod and will not open up or slip off the well head.

2. Description of the Prior Art

The basic concept of providing a device commonly called a knock-off block when servicing or repairing oil field pumping equipment is a well established practice. The so-called knock-off block is a spacer used to support the string of sucker rods in the oil well while work is being done on the engine or motor, gear box, pump jack, bridle or any other part of the aboveground pumping equipment. Ordinarily, the knock-off block is made from a two inch pipe or the like that has an approximately one and a half inch wide slot cut longitudinally along the length of the pipe. The slotted pipe than has two horseshoe shaped steel plates welded to the top and bottom with the open sides in alignment with the slot in the pipe. To use the knock-off block, the pump jack is stopped at the top of the stroke. The slot in the knock-off block is placed over the polish rod and the knock-off block is held in place by hand or is fastened in place, usually using wire or rope as the fastener. The pump jack is then lowered so that the polish rod liner head engages the knock-off block. The pump jack is lowered to the bottom of the stroke and stopped. Work can then be performed on the pump equipment.

This type of knock-off block is well known for its dangerous behavior. It sometimes slips off the polish rod after weight is applied by lowering the rods, thus breaking the fastening devices and risking personal injury.

Various attempts have been made to alleviate the above problem with limited commerical success. For example, in U.S. Pat. No. 1,196,647 spring biased jaws that surround the polish rod are provided to prevent the polish rod from exiting the slot. Such a solution is not fail-safe in that the device can still malfunction or be opened during use. Thus, a need for an inexpensive yet reliable safety block that cannot be removed or accidentally opened during use still exists.

SUMMARY OF THE INVENTION

In view of the previously known types of knock-off blocks and their associated deficiencies, I have discovered an improved fail-safe knock-off block. Thus, the present invention provides a safety block comprising:

(a) a longitudinally slotted pipe wherein the slot is adapted to fit over the polish rod of an oil well pump in an axial orientation;

(b) a slotted top plate perpendicularly attached to a longitudinally slotted pipe section wherein the slots are adapted to fit over the polish rod of the oil well pump in an axial orientation and wherein the longitudinally slotted pipe section of the top is further adapted to concentrically engage with the longitudinally slotted pipe;

(c) a slotted bottom plate perpendicularly attached to another longitudinally slotted pipe section wherein the slots are adapted to fit over the polish rod of the oil well pump in an axial orientation and wherein the longitudinally slotted pipe section of the bottom is further adapted to concentrically engage to the other end of the longitudinally slotted pipe; and (d) a resilient attachment means connecting the top and bottom plates which are concentrically engaged to the longitudinal slotted pipe thus allowing the plates with slotted pipe segments to rotate axially relative to the longitudinally slotted pipe during no-load and to flex during compression thus interlocking the concentric pipe sections and pipe during use of the safety block. The present invention further provides that the resilient attachment means connecting the top and bottom plates also serves as a handle to aid in the axial rotation of the pipe segments and perpendicular plates and that the slotted pipe is also equipped with a handle to assist in this axial rotation.

It is a primary object of the present invention to provide a safety block which can be readily and easily mounted or removed from the polish rod when no load is being applied. It is a further object that the safety block completely encircle the polish rod and be locked in place when compressed by the weight of the sucker rod string such that the safety block cannot fall off the well head. Fulfillment of these objects and the presence and fulfillment of other objects will be apparent upon reading of the specification and claims taken in conjunction with the attached drawings.

DESCRIPTION OF THE PREFERRED EMBODIMENTS

The safety block according to the present invention, how it functions, and how it differs from the previously known knock-off blocks can perhaps be best explained and understood by reference to the drawings.

Figure 1:
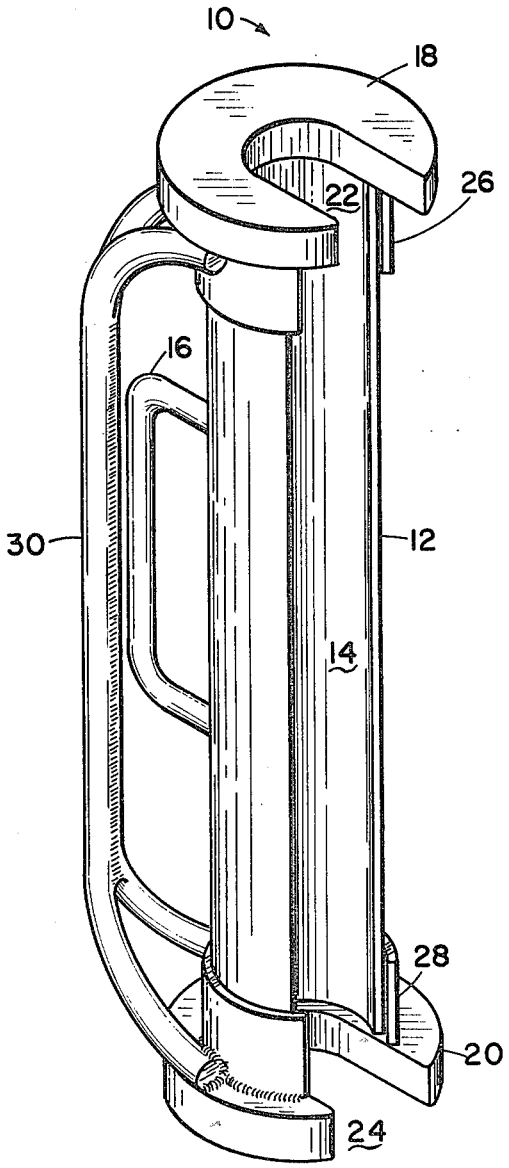
FIG. 1 is a perspective view of the safety block according to the present invention.

FIG. 1 is a perspective view of the safety block, generally designated by the numeral 10. As illustrated, the safety block 10 is made up of a central or inner pipe 12 having a vertical (longitudinal) slot 14 traversing the entire length of the inner pipe. A handle 16 is attached to the outer portion of the pipe 12 opposite the slot 14. On the top and bottom of the inner pipe 12 are two flat surfaces 18 and 20 equipped with slots 22 and 24. Welded to each flat surface 18 and 20 are slotted pipe segments 26 and 28. The slots of the pipe segments 26 and 28 are permanently aligned with the slots 22 and 24 of the flat surfaces. As further illustrated, the pipe segments 26 and 28 are concentrically positioned on the top and bottom of the pipe 12. A resilient handle 30 is welded to the flat surfaces 18 and 20, thus holding the pipe segments and flat surfaces suspended away from the ends of the inner pipe 12. In this manner, the inner pipe 12 is free to rotate axially within the safety block 10, by merely rotating handle 16 relative to handle 30.

Figure 2:
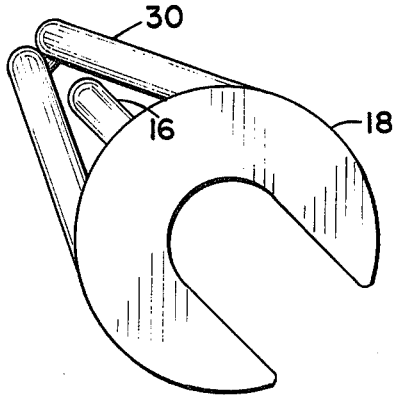
FIG. 2 is a top view of the safety block of FIG. 1 when open.
Figure 3:
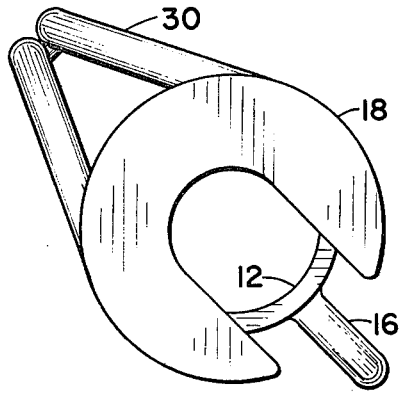
FIG. 3 is a top view of the safety block of FIG. 1 when closed.

As illustrated in FIG. 2, when both handles 16 and 30 are rotated next to each other, all slots are aligned allowing the safety block to be easily and readily placed on or removed from the polish rod of the pumping unit. However, when the handles are rotated opposite to each other, see FIG. 3, the polish rod will be entirely encircled. As the polish rod is lowered, the weight of the sucker rod string will compress the upper flat surface 18 against central pipe 12 with sufficient force that the safety block 10 will be locked in position and absolutely cannot slip off the well head. The pump jack can then be detached from the sucker string and the necessary repair or service performed on the pumping equipment. Upon reassembly and attachment to the sucker rod string, the tension on the safety block is removed by lifting the string. The safety block can now be quickly opened and removed with minimum risk to the personnel.

The safety block of the present invention can be made out of any high strength material generally employed in oil field equipment or the like. Various alternative designs to the overall unit are envisioned as being equivalent to the illustrated embodiment. For example, one or more of the handles can either be eliminated or incorporated into other elements of the device. The segmented pipes attached to the flat surfaces can readily be one continuous pipe with or without a discrete handle. In such an embodiment, the inner handle can readily be a pin or post extending through a circumferential slot or the like. Also, the resilience necessary to create the locking effect can be associated with the flexing of the sidewall rather than the bending of an external handle.

Having thus described and exemplified the preferred embodiments with a certain degree of particularity, it is manifest that many changes can be made within the details of the safety block without departing from the spirit and scope of this invention. Therefore, it is to be understood that the invention is not limited to the embodiments set forth herein for purposes of exemplification, but is to be limited only by the scope of the attached claims, including the full range of equivalents to which each step thereof is entitled.

I claim:

1. A safety block comprising:

(a) a longitudinally slotted pipe wherein said slot is adapted to fit over the polish rod of an oil well pump in an axial orientation;

(b) a slotted top plate perpendicularly attached to a longitudinally slotted pipe section wherein said slots are adapted to fit over said polish rod of said oil well pump in an axial orientation and wherein said longitudinally slotted pipe section of said top is further adapted to concentrically engage with said longitudinally slotted pipe;

(c) a slotted bottom plate perpendicularly attached to another longitudinally slotted pipe section wherein said slots are adapted to fit over said polish rod of said oil well pump in an axial orientation and wherein said longitudinally slotted pipe section of said bottom is further adapted to concentrically engage to the other end of said longitudinally slotted pipe; and (d) a resilient attachment means connecting said top and bottom plates which are concentrically engaged to said longitudinal slotted pipe thus allowing said plates with slotted pipe sections to rotate axially relative to said longitudinally slotted pipe during no-load and to flex during compression thus interlocking said concentric pipe sections and pipe during use of said safety block.

2. A safety block of claim 1 wherein said resilient attachment means connecting said top and bottom plates is also a handle to aid in said axial rotation of said pipe segments.

3. A safety block of claim 2 wherein said axially slotted pipe is also equipped with a handle to assist in said axial rotation.

* * * * *